US006214420B1

(12) United States Patent
Girardin et al.

(10) Patent No.: US 6,214,420 B1
(45) Date of Patent: Apr. 10, 2001

(54) PROCESS AND PLANT FOR METALLIZATION OF CAST-IRON PIPES

(75) Inventors: Denis Girardin, Maidieres; Christophe Lamouret, Pont-a-Mousson; Joel L'Huillier, Raucourt, all of (FR)

(73) Assignee: Pont-A-Mousson, Nancy (FR)

( * ) Notice: Subject to any disclaimer, the term of this patent is extended or adjusted under 35 U.S.C. 154(b) by 0 days.

(21) Appl. No.: 09/171,974

(22) PCT Filed: Apr. 28, 1997

(86) PCT No.: PCT/FR97/00756

§ 371 Date: Apr. 30, 1999

§ 102(e) Date: Apr. 30, 1999

(87) PCT Pub. No.: WO97/42355

PCT Pub. Date: Nov. 13, 1997

(30) Foreign Application Priority Data

May 2, 1996 (FR) ..... 96 05510

(51) Int. Cl.[7] ..... C23C 4/08; B05C 5/04

(52) U.S. Cl. ..... 427/455; 427/449; 427/456; 118/313; 118/315; 138/145; 138/146

(58) Field of Search ..... 427/446, 449, 427/455, 456; 118/313, 315, DIG. 11; 219/121.47, 121.53, 121.58; 164/459, 464; 138/145, 146

(56) References Cited

U.S. PATENT DOCUMENTS 1,978,415 10/1934 Collins .
3,947,607 * 3/1976 Gazzard et al. ..... 427/37
4,690,199 * 9/1987 Gourmel et al. ..... 164/421
4,901,908 * 2/1990 Negura et al. ..... 228/183
5,133,126 7/1992 Matsuoka .
5,482,734 * 1/1996 Herwig et al. ..... 427/8
5,706,866 * 1/1998 Pedeutour et al. ..... 138/145
5,960,835 * 10/1999 Izaki et al. ..... 138/145

FOREIGN PATENT DOCUMENTS 763368 3/1954 (GB) .
WO 94/13472 6/1994 (WO) .

OTHER PUBLICATIONS

Patent Abstracts of Japan, vol. 7, No. 114, May 1983.
Patent Abstracts of Japan, vol. 10, No. 245, Apr. 1986.

* cited by examiner

*Primary Examiner*—Shrive Beck
*Assistant Examiner*—Jennifer Calcagni
(74) *Attorney, Agent, or Firm*—Sughrue, Mion, Zinn, Macpeak & Seas, PLLC

(57) ABSTRACT

A plant for metallization of a metal pipe obtained by upward vertical continuous casting and displaced vertically in a continuous manner, includes, along the path of the pipe, a metallization station having a passage for the pipe, a metallization enclosure (6), spray guns (11) mounted inside the enclosure on an oscillating plate (10) surrounding the path, means for supplying each gun with metallization material (12), and a device for causing oscillation of the support plate and for displacing the guns inside the enclosure with an oscillating movement, the frequency and angular amplitude of which ensure the formation of a coating of uniform thickness.

22 Claims, 4 Drawing Sheets

PROCESS AND PLANT FOR METALLIZATION OF CAST-IRON PIPES

BACKGROUND OF THE INVENTION

The present invention relates to a process for metallization of metal substrates and relates more particularly to the hot metallization of pipes, in particular cast-iron pipes which are obtained by means of vertical continuous casting.

Among the known processes for the hot metallization of pipes, the following are known:

customized hot-galvanization;

the continuous coating of steel plates with Zn or ZnAl;

methods for thermal spraying with Zn or ZnAl alloys;

zinc-coating of pipes.

The existing solutions based on galvanization have the following drawbacks.

Customized hot-galvanization coats the pipe internally and externally and the pipe undergoes an increase in temperature such that the results of other prior operations carried out on the pipe at lower temperatures risk being affected.

Hot galvanization by movement through a liquid poses the problem, currently unsolved, of tightness with respect to the liquid bath between the vertical pipe and the liquid metal, as well as the problem of maintaining a bath which is clean (without matte) and has a stable composition over time.

Cold metallization associated with annealing would ensure good distribution if rigorous conditions for preparation of the pipe surface are satisfied and would probably require heat treatment in an inert atmosphere.

The cost of such a treatment cycle would be considerable and as a result would offer limited advantages from an economic point of view.

The pipe to be coated, emerging after continuous casting, is not rough, which makes fixing of a cold coating impossible without carrying out surface preparation.

In order to obtain a well-distributed coating, a pipe without an oxide skin is necessary and the working temperature must be high or else the pipe handling time must be long.

SUMMARY OF THE INVENTION

The invention aims to provide a uniformly distributed coating which has a good impact resistance.

Moreover an object of the invention is to provide a coating which adheres very well to the outside of a pipe of varying position and diameter, continuously moving in a vertical direction and without undergoing rotation, while preventing the pipe from being subject to heat annealing.

Furthermore an object of the invention is to provide a coating which is "self-healing" in respect of any damage suffered.

Finally, an object of the invention is to provide a coating which contributes to corrosion resistance in underground conditions.

The invention therefore relates to a process for metallization of a metal pipe obtained by vertical casting and displaced vertically in a continuous manner with an upward movement, characterized in that it consists in:

cooling the pipe in an atmosphere which is inert with respect to oxidation up to a temperature of 700 to 900° C.; and spraying onto the pipe, cooled beforehand to the aforementioned temperature, a zinc-based metallization alloy with the aid of a set of spray guns arranged so as to surround the path of the pipe to be metallized.

According to a particular characteristic feature of the invention, the spray guns are made to oscillate about the path of the pipe with a frequency and an angular amplitude adapted to the speed of displacement of the pipe with a view to obtaining a coating of uniform thickness.

The invention also relates to a plant for metallization of a metal pipe obtained by means of upward vertical continuous casting and displaced vertically in a continuous manner, characterized in that it comprises, along the path of the pipe, a metallization station comprising a passage for the pipe, a metallization enclosure, spray guns mounted inside the said enclosure on an oscillating plate surrounding the said path, means for supplying each gun with metallization material and means for causing oscillation of the support plate and for displacing the guns inside the said enclosure with an oscillating movement, the frequency and angular amplitude of which ensure the formation of a coating of uniform thickness.

The invention relates moreover to a metal pipe obtained by means of vertical casting, characterized in that it has a metallization coating obtained by the process defined above.

According to another particular characteristic feature, the spray guns are three in number and are arranged on the plate at 120° from one another.

According to another particular characteristic feature, the spray guns are flame guns or arc guns.

According to another characteristic feature of the invention, the metallization material is a wire of $Zn_xAl_{1-x}$ alloy and the means for supplying metallization material comprise for each gun a wire store and an unwinding device operated by the oscillation movement of the plate supporting the guns.

BRIEF DESCRIPTION OF THE DRAWINGS

The invention will be understood more fully upon reading of the description which follows, provided solely by way of example and with reference to the accompanying drawings, in which.

DETAILED DESCRIPTION OF THE PREFERRED EMBODIMENT

Figure 1:
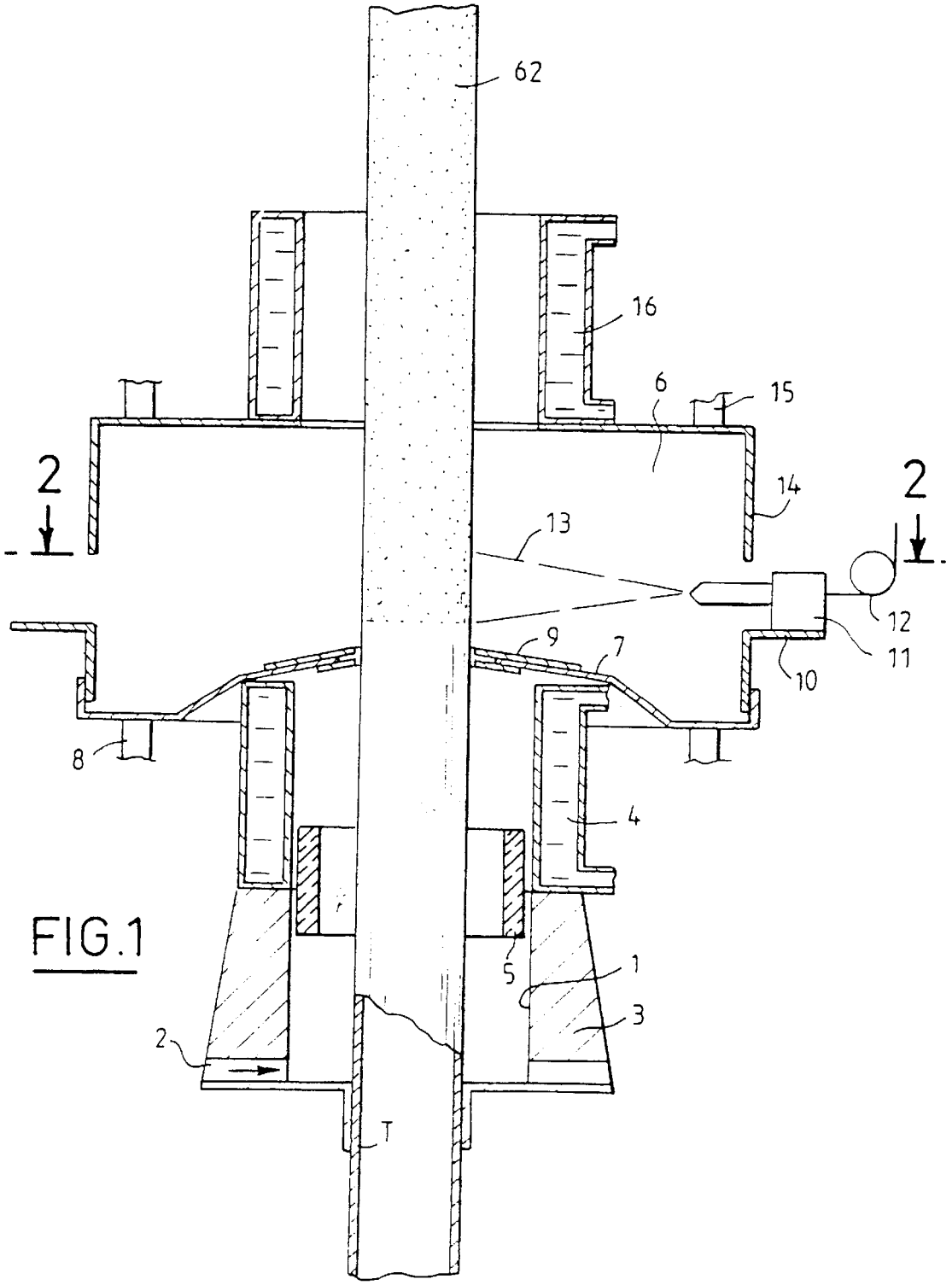
FIG. 1 is a diagrammatic, vertically sectioned view of a metallization plant according to the invention.

The metallization plant shown in FIG. 1 has, along the path of a pipe T obtained in an upward vertical continuous casting plant (not shown) and above this plant, a shaft 1 for passage of the pipe T being manufactured, into which there is injected, via a duct 2, nitrogen for allowing the pipe T to be displaced between he casting plant outlet and the metallization plant in an atmosphere protecting the surface of the pipe T against oxidation.

The shaft 1 has a lower part 3 which the pipe gradually cools during its upward movement from 1100° C. to 1000° C. and a water-cooled upper part 4 situated immediately below the metallization zone and inside which the temperature of the pipe cools from 1000° C. to a temperature of between 700 and 900° C.

A sliding mask 5 made of heat-insulating material is arranged inside the shaft 1 at the level of the joint between the lower part 3 and the upper part 4 of the latter and its movement inside the upper part 4 allows cooling of the pipe T to be controlled by means of positioning between the pipe and the wall of the said cooled part.

Above the shaft 1 there is arranged a metallization enclosure 6 comprising a bottom 7 inclined downwards, from the center towards the periphery, and provided with suction ducts 8.

In its central part, the bottom 7 is connected to a drop prevention cover 9 through which the pipe T to be coated passes with a minimum amount of play so as to prevent the sprayed metallization product which does not adhere to the pipe wall from falling towards the bottom of the plant.

The enclosure has moreover an oscillating plate 10 on which spray guns such as flame metallization guns 11 are mounted.

Each gun is supplied with metallization wire 12 in a manner which will be described with reference to FIGS. 2 to 4.

The guns 11 are for example three in number and are arranged on the plate 10 at 120° from one another.

Each gun 10 sprays a jet 13 of metallization material onto the pipe T during its upward movement.

The spray guns may also be arc guns.

They may also consist of devices for atomization of liquid metal.

Flame guns, however, have the advantage that they constitute a heat technology which does not disturb the cooling kinetics of the product.

They ensure an excellent performance with regard to the spraying of the atomized droplets of alloy because these droplets are not driven away from the substrate as, for example, in the case where arc guns are used.

The flow of flame guns is finer than that of arc guns.

They require only one wire of metallization material, while two wires are required for arc guns.

The upper wall 14 of the enclosure 6 also has suction ducts 15.

The enclosure 6 has mounted on it a water-cooled casing 16 allowing the metallized pipe to emerge form the metallization plant at a temperature of 750° C. and forming a thermal screen which prevents the plant from becoming overheated.

Figure 2:
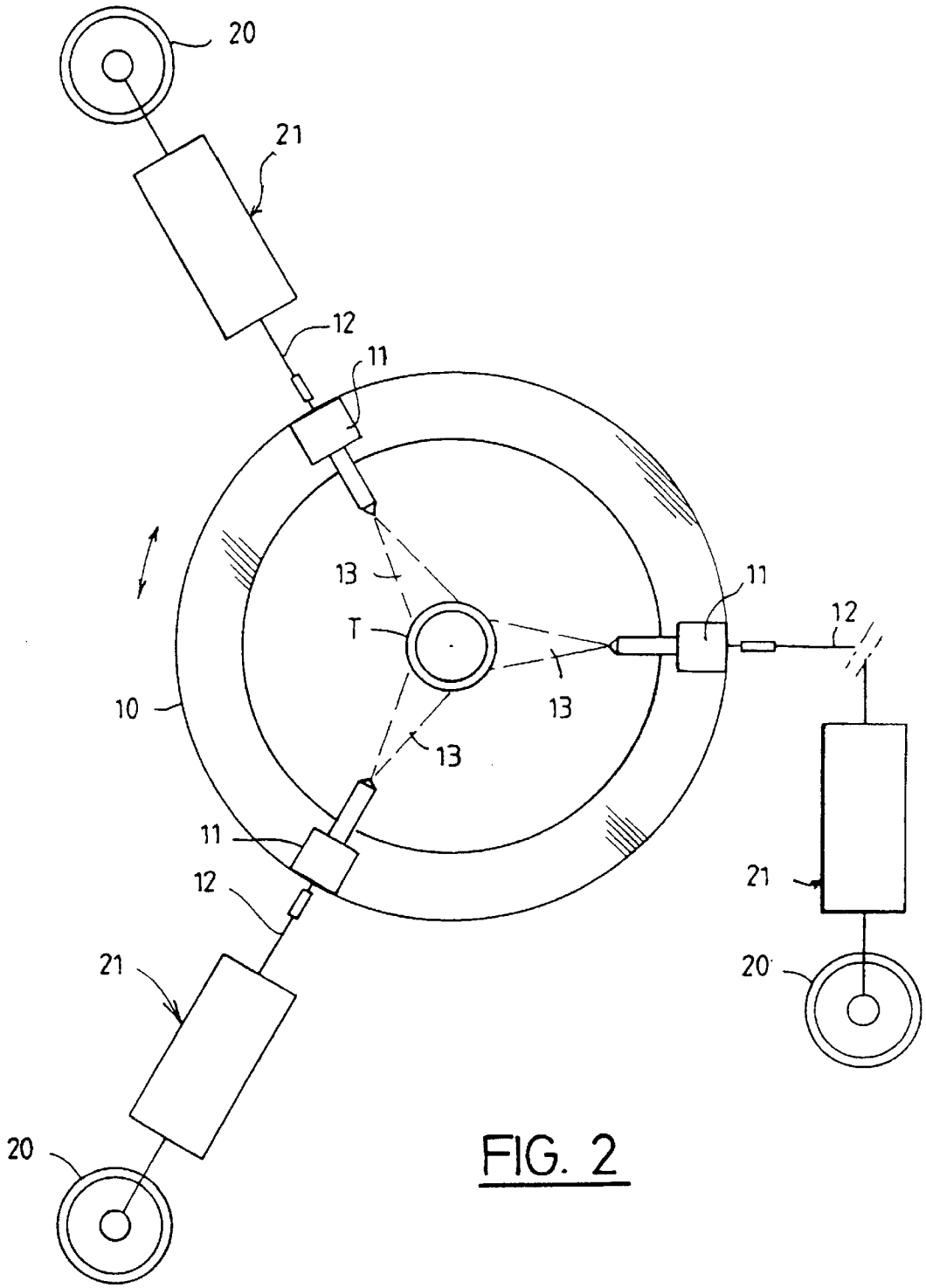
FIG. 2 is a diagrammatic view sectioned along the line 2—2 of FIG. 1.

The plant shown in cross-section in FIG. 2 has a platform (not shown) through which the pipe being formed passes and on which the metallization chamber provided with the annular plate 10 is mounted.

The plate 10 is driven in rotation with an oscillating movement by a suitable mechanism, not shown.

As mentioned further above, in the present example, said plate carries three flame metallization guns 11.

This number of three ensures the best compromise between the cost of the plant and the uniformity of the thickness of the coating. However, the number of guns may be different from three.

The amplitude of angular displacement of the plate 10 as well as its frequency are a function of the angle of dispersion of the jets 13 of molten metal which are sprayed by the guns 11 as well as the speed of displacement of the pipe T so as to allow application of a metallization layer of uniform thickness.

Each metallization gun 11 which has means for supplying oxygen and gas by means of suitable hoses (not shown) has associated with it a device for supplying metallization product in the form of wire 12.

Each device comprises a wire store 20 and an unwinding device denoted by the general reference 21, intended to convey the metallization wire 12 from the wire store 20 to the associated gun 11, taking account of the oscillating movements to which the gun 11 mounted on the oscillating plate 10 is subjected.

The wire 12 advantageously consists of an alloy containing 5 to 15% of Al.

It is also possible to use a lined wire consisting of a Zn core surrounded by an Al sheathing, in which case, after melting, a $Zn_{45}Al_{55}$ alloy may be obtained. The lined wire may also consist of an aluminum core and a Zn sheathing.

The best lined wire or the best alloy is chosen in order to arrive at a desired metallization composition of the $Zn_ZAl_{1-Z}$ type.

Figure 3:
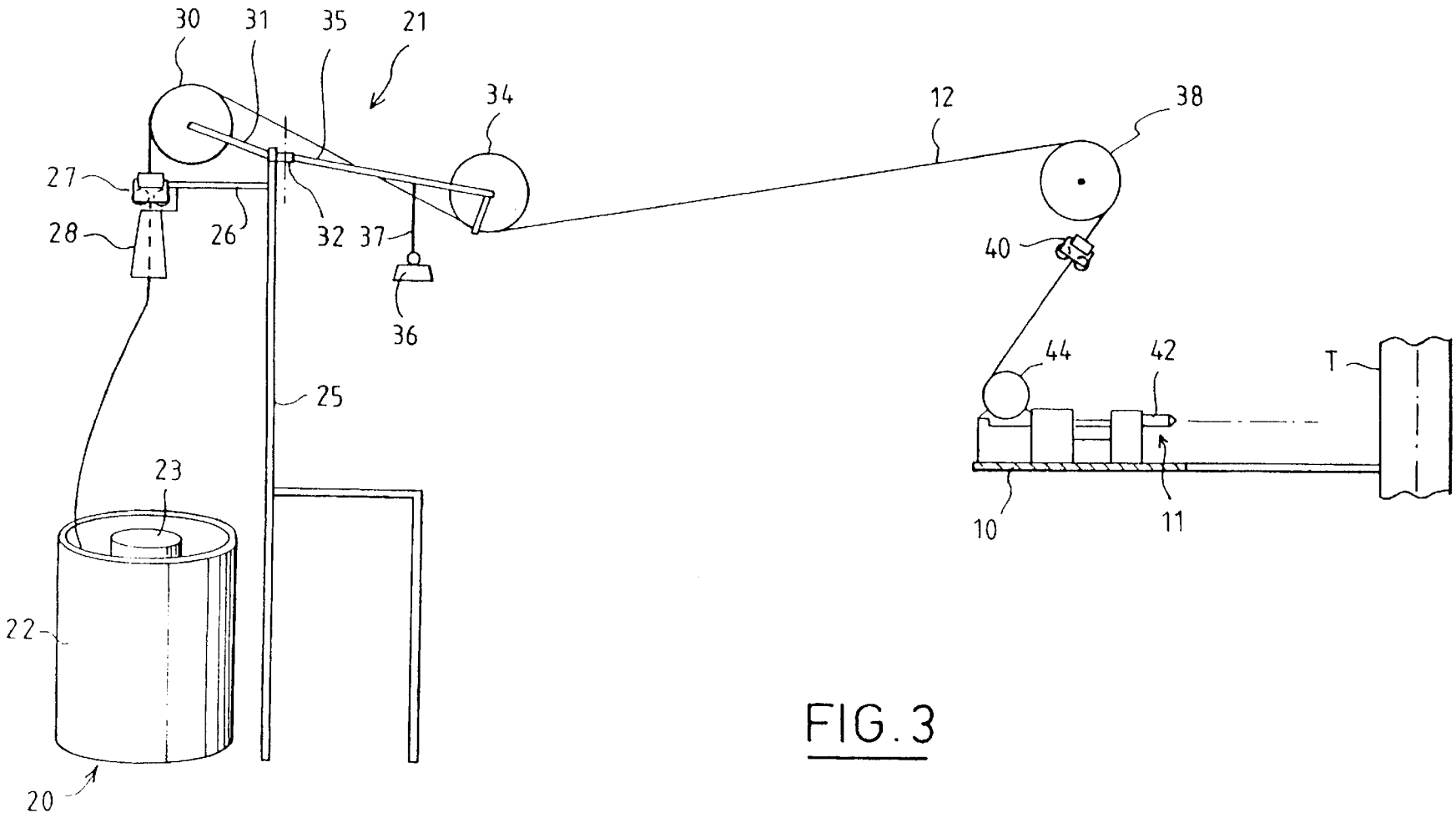
FIG. 3 is a partial diagrammatic side view of the metallization plant according to FIG. 1.

FIG. 3 shows one of the spray guns 11 mounted on the oscillating plate 10 of the plant as well as the wire store 20 and the associated unwinding device or unwinder 21.

The metallization wire 12 is positioned in coil form inside a drum 22, for example a drum of the standard type for oil products, provided with a central core 23 on which the wire coil (not shown) is treated inside the drum.

Alongside the drum there is arranged a frame 25 comprising a bracket 26 which supports a wire straightening device 27 with four rollers with which there is associated an entry cone 28 for the wire 12, directed towards the drum 22.

At the exit of the wire straightening device 27 there is arranged a set of wheels, a first wheel 30 of which is mounted on a slanting support 31 fixed at a point 32 of the vertical upright of the bracket 26. A second wheel 34 is mounted oscillating about a point close to the point 32 for fixing of the first wheel 30 by means of a movable support or bracket 35 from which a weight 36 is suspended.

The weight 36 is fixed to a rod 37 hinged on the bracket 35.

A third wheel 38 for redirecting the wire towards the plate, arranged above the oscillating plate 10, is fixed to the structure of the plant, not shown.

At the exit of the third wheel 38 there is provided a second wire straigthened device with four rollers 40.

The gun 11 has mounted at its rear end, opposite to its spray nozzle 42, a fourth wheel 44 or wheel for admitting wire into the gun, mounted on a pivoting support and allowing modification of the inclination of the metallization wire 12 according to the oscillations of the plate 10.

The metallization wire 12 is removed from the storage coil contained inside the drum 22, passes through the entry neck 28, is straightened a first time inside the straightening device 27, passes over the first wheel 30, then underneath the second wheel 34, and then again over the third wheel 38. It is kept tensioned by the weight 36 acting on the oscillating bracket 35 supporting the second wheel 34.

It is again straightened by the second wire straightening device with four rollers 40 and enters into the flame gun 11 after passing over the fourth wheel 44.

The gun 11 has a device for driving the wire so as to bring it into the melting zone.

This device known per se and not shown comprises a servomotor with an incorporated tacho generator, a transmission assembly with reducing gears and pulleys for driving the wire and a device for pneumatic clamping of the pulleys, which, by means of a piston, ensures clamping of the wire between them.

Figure 4:
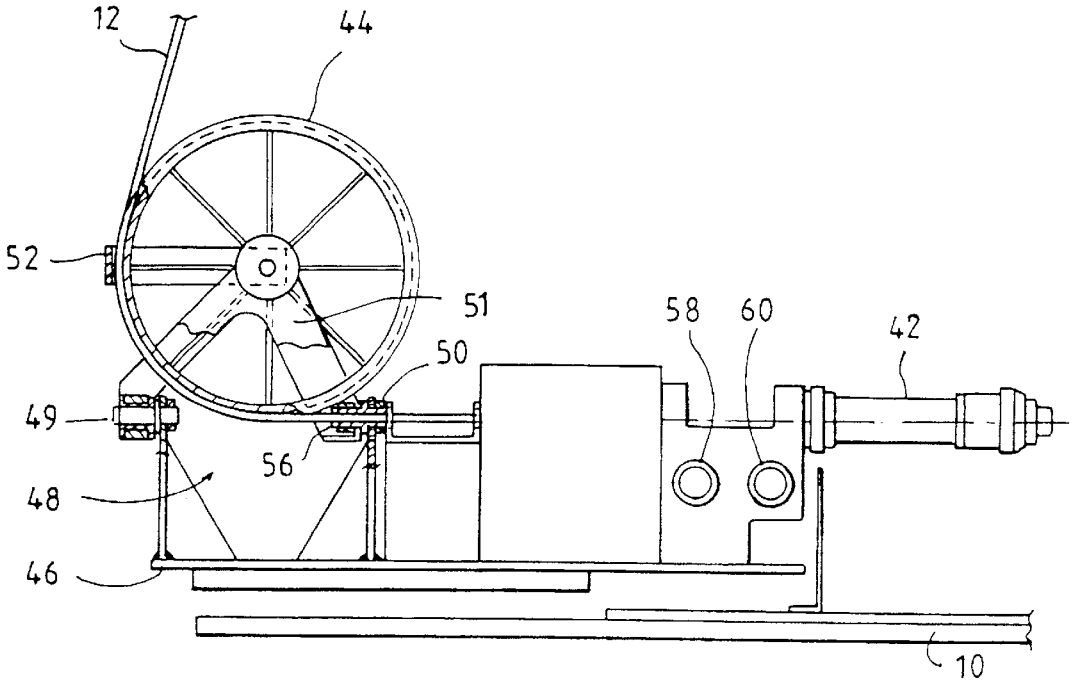
FIG. 4 is a partially sectioned view of a flame gun of the plant.

As can be seen more clearly in FIG. 4, the flame gun 11 which has a base 46 fixed to the plate 10 is provided at its end opposite to the metallization nozzle 42 with a cradle 48 comprising bearings 49, 50 on which a fork member 51 supporting the fourth admission wheel 44 is mounted in an oscillating manner.

The bearings 49 and 50 are oriented radially with respect to the oscillating plate 10.

A guide 52 for the metallization wire 12 at the entry of the wheel 44 is moreover mounted on the fork member 51.

The bearing 50 of the cradle 48 which is located closest to the melting zone of the gun 42 has an axial passage 56 through which the wire 12 passes.

The gun has, moreover, connection sockets 58, 60 intended to receive hoses, not shown, supplying the gun with gas and oxygen.

The gas used may advantageously be propane, acetylene or natural gas.

The ZnAl alloy of the wire is therefore conveyed towards the melting zone of the spray gun 11 so as to be melted there into fine droplets and sprayed.

The pipe T to be metallized being at the right working temperature, i.e. at about 800° C. and free from surface oxides owing to the nitrogen atmosphere which surrounds it in the metallization zone, receives jets 13 emitted by the guns 11, consisting of a mist of ZnAl droplets which adhere thereto.

As a result of the translational movement of the pipe together with the alternating rotational movement of the guns 11, it is possible to ensure a good uniformity in the thickness of the coating 62 obtained.

The alloy remains liquid on the pipe, but does not run owing to a capillary effect and also because of the very rapid surface oxidation and surface solidification of the external coating thus obtained.

During the entire cooling phase which follows the metallization phase and which lasts about 15 minutes, the alloy reacts with the cast iron of the material which forms the pipe, so as to form intermetallic compositions of the type $Fe_x$, $Al(_{1-x})$ charged with a small proportion of interstitial Zn.

The result obtained is a pipe coated with an external coating which is formed such that it is continuous and perfectly adherent.

The suction system associated with the enclosure and connected in particular to the suction ducts 8, provided in the bottom 7, and suction ducts 15, provided in the upper wall 14 of the said enclosure, allow recovery of the alloy droplets which have not reached the pipe.

By way of example a certain amount of numerical data relating to the operating parameters and to the nature of the metallization alloy used is given below.

The feed speed of the wire 12 is 3 m/min., its diameter is 4 mm and its linear mass is 70 g/m.

The production yield is of the order of 50%.

As mentioned above, the wire is made either in the form of a $Zn_{85}Al_{15}$ alloy or in the form of a lined wire with a Zn core, making it possible to obtain a $Zn_{45}Al_{55}$ alloy.

The angle of rotation of the spray guns 11 is 95°.

The pitch of the spraying cycle is 70 mm.

In the tests carried out it has been possible to obtain a coating of 100 g/m$^2$ to 500 g/m$^2$ with a $Zn_{85}$ and $Al_{15}$ alloy.

Figure 5:
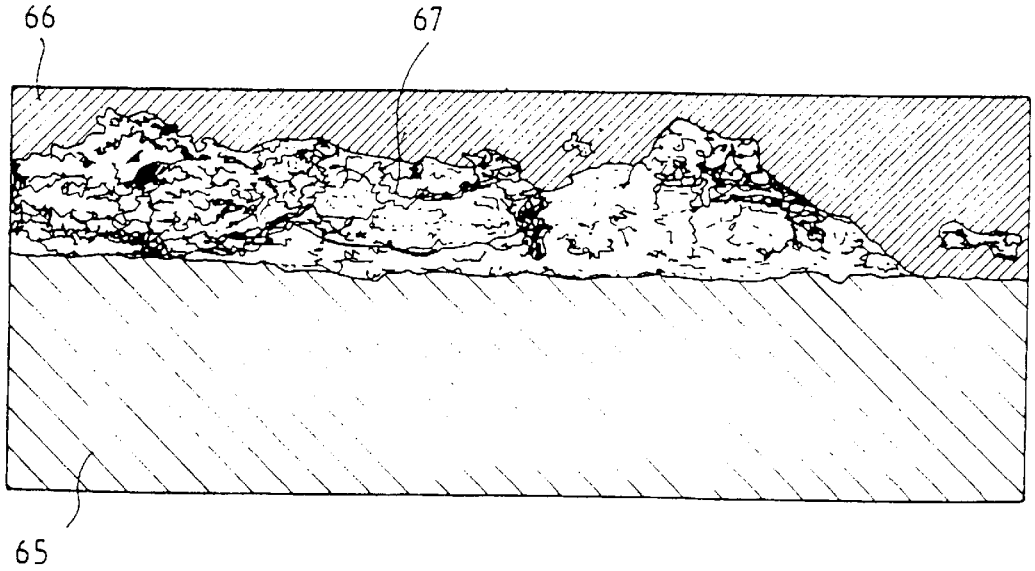
FIG. 5 is a micrograph of a coating obtained by the process according to the invention.

As shown in FIG. 5, the micrograph of a section through the coating obtained clearly shows the formation of a well-distributed interface.

In this figure, in fact, it can be seen that a well-distributed intermetallic interface 67 has formed between the cast-iron wall 65 and the ZnAl coating layer 66.

During the impact tests carried out on the coated pipe it was possible to reach values of up to 150 J, i.e. up to deformation of the pipe without deterioration of the coating.

The corrosion characteristics of the coating obtained are on a par with those which could be obtained by means of customized hot galvanization on a same substrate and with the same alloy.

During coating, the pipe is not subject to any annealing effect.

The metallization process according to the invention has the following advantages with respect to the state of the art.

It allows the thickness of the metallization coating to be controlled by adjustment of the feed speed of the wires of metallization alloy.

It enables a continuous linear coating to be obtained.

It enables a well-distributed anti-corrosion coating to be obtained.

It allows easy application of a sealant owing to the roughness conferred to the initially smooth pipe by the metallization coating.

Finally it allows lined wire as well as other alloys to be used.

What is claimed is:

1. Process for metallization of a metal pipe obtained by vertical casting and displaced vertically in a continuous manner with an upward movement, comprising the steps of:

cooling the pipe in an atmosphere inert with respect to oxidation to a temperature of 700 to 900° C.; and spraying onto the cooled pipe during the continuous, non-rotational vertical ascent thereof, a zinc-based metallization alloy with a set of spray guns arranged so as to surround the path of the pipe to be metallized.

2. Process according to claim 1, wherein the zinc-based alloy is $Zn_xAl_{1-x}$.

3. Process according to claim 1, wherein the metallization alloy is in the form of a wire.

4. Process according to claim 3, wherein the said wire is a wire of an alloy comprising between 5 and 15% of Zn.

5. Process according to claim 3, wherein the said wire is a wire of $Zn_{85}Al_{15}$.

6. Process according to claim 3, wherein the said wire is a lined wire consisting of a Zn core surrounded by an Al sheathing allowing a $Zn_{45}Al_{55}$ alloy to be obtained after melting.

7. Process according to claim 3, wherein the said wire is a lined wire consisting of an Al core surrounded by a Zn sheathing.

8. Plant for metallization of a metal pipe obtained by upward vertical continuous casting and displaced vertically in a continuous manner, comprising, along the path of the pipe, a metallization station comprising a passage for the pipe, a metallization enclosure (6), spray guns (11) mounted inside said enclosure on an oscillating plate (10) surrounding the path, means (20, 21) for supplying each gun with metallization material (12), and means for oscillating the support plate and for attendantly displacing the guns inside the enclosure with an oscillating movement, wherein the frequency and angular movement of oscillation is selected to ensure the formation of a coating of uniform thickness.

9. Plant according to claim 8, wherein the passage for the pipe (T) to be coated comprises a lower part (3), a water-cooled upper part (4), a sliding mask (5) for controlling cooling of the pipe (T) being arranged at the joint between the lower part (3) and upper part (4), the metallization enclosure (6) being arranged above the said upper part (4) and having mounted on it a water-cooled casing (16).

10. Plant according to claim 8, wherein the spray guns (11) are three in number and are arranged on the plate at 120° from one another.

11. Plant according to claim 8, wherein the spray guns (11) are flame guns or arc guns.

12. Plant according to claim 8, wherein the metallization material (12) is a wire of ZnAl alloy and the means for supplying metallization material comprise for each gun a wire store (20) and an unwinder (21) operated by the oscillation movement of the plate (10) supporting the guns provided with means for driving the wire.

13. Plant according to claim 8, wherein the metallization enclosure (6) has a bottom (7) inclined downwards, from the centre towards the periphery and provided with suction orifices (8), the said bottom (7) being connected at its centre to a drop prevention cover (9) through which the pipe (T) to be coated passes with a minimum amount of play in order to prevent the sprayed metallization product which does not adhere to the pipe wall from falling towards the bottom of the plant.

14. Plant according to claim 8, wherein the means for supplying each gun (11) with metallization product (12) comprise a wire store (20) and a device for unwinding the said wire from the store and conveying it towards the corresponding gun (11).

15. Plant according to claim 14, wherein the wire store associated with each gun (11) comprises a drum (22) for receiving a coil of metallization wire provided with a central core (23) onto which the coil of wire is threaded.

16. Plant according to claim 14 wherein the device for unwinding the metallization wire comprises a set of wheels (30,34,38) for conveying the wire (12) from the store (20) to above the oscillating plate (10) and a wheel (44) for admitting into the corresponding gun (11) the wire supplied by the set of wheels (30,34,38), the said admission wheel being mounted oscillating on the gun in a radial direction of the said plate (10), its orientation following the oscillations of the said plate (10).

17. Plant according to claim 16, wherein the set of wheels (30,34,38) comprises a first wheel (30) supporting the wire (12) and mounted on a fixed support (31), a second wheel (34) passing underneath the wire (12) and mounted on an oscillating support (35) with which means (36,37) for tensioning the wire (12) are associated and a third wheel (38) for redirecting the wire (12) towards the wheel (44) for admitting the wire into the gun (11).

18. Plant according to claim 17, wherein the unwinding device has, moreover, between the drum (22) and the first wheel (30), an entry cone (28) for the wire (12) and a first wire straightening device (27) and, at the exit of the third wheel (38), a second wire straightening device (40).

19. Plant according to claim 17, wherein the means for tensioning the wire (12) comprise a weight (37) suspended from the oscillating support (35) of the second wheel (34).

20. Plant according to claim 16, wherein the wheel (44) for admitting the wire (12) into the gun (11) is mounted oscillating inside a cradle (48) of the latter by means of a fork member (51) and bearings (49,50) arranged radially with respect to the oscillating plate (10), the bearing (50) closest to the melting zone of the gun (11) comprising a passage (56) through which the wire (12) passes.

21. Metal pipe obtained by vertical casting, wherein it has a metallization coating obtained by the process according to claim 1.

22. Process according to claim 1, further comprising oscillating the spray guns about the path of the pipe.

* * * * *